United States Patent [19]

Becker

[11] 4,141,183

[45] Feb. 27, 1979

[54] PRESTRESSED HOLLOW CHAMBER COMPOSITE STRUCTURAL ELEMENT CAPABLE OF SUPPORTING HEAVY LOADS

[76] Inventor: Otto A. Becker, Robert-Koch-Strasse 59, D-6600 Saarbrucken 6, Fed. Rep. of Germany

[21] Appl. No.: 865,574

[22] Filed: Dec. 29, 1977

[30] Foreign Application Priority Data

| | | | |
|---|---|---|---|
| Dec. 30, 1976 | [AT] | Austria | 9826/76 |
| Dec. 31, 1976 | [CH] | Switzerland | 16501/76 |
| Apr. 2, 1977 | [DE] | Fed. Rep. of Germany | 2714920 |

[51] Int. Cl.[2] ..... E04B 2/14; E04B 1/40; E04B 1/90

[52] U.S. Cl. ..... 52/127; 52/173 R; 52/222; 52/404; 52/584; 52/785; 52/809

[58] Field of Search ..... 52/109, 173 R, 222, 52/127, 227, 228, 223 R, 404, 785, 791, 808, 809, 584

[56] References Cited

U.S. PATENT DOCUMENTS

| | | | |
|---|---|---|---|
| 1,708,351 | 4/1929 | Auld | 52/222 |
| 2,360,500 | 10/1944 | Johnson | 52/222 |
| 2,805,739 | 9/1957 | Dennison | 52/222 |
| 2,825,432 | 3/1958 | Parkes | 52/222 |
| 3,369,334 | 2/1968 | Berg | 52/584 X |
| 3,811,239 | 5/1974 | Becker | 52/173 R |
| 3,990,202 | 11/1976 | Becker | 52/173 R |
| 3,991,531 | 11/1976 | Becker | 52/173 R |
| 4,045,931 | 9/1977 | Becker | 52/222 X |
| 4,071,992 | 2/1978 | Becker | 42/223 R |

FOREIGN PATENT DOCUMENTS

| | | | |
|---|---|---|---|
| 2019666 | 12/1971 | Fed. Rep. of Germany | 52/173 R |

*Primary Examiner*—Alfred C. Perham
*Attorney, Agent, or Firm*—Donald D. Jeffery

[57] ABSTRACT

A hollow-chamber composite structural element is capable of carrying high load and is prestressed in the direction of its length and against the direction of loading. The element comprises two outer structural shells connected with each other, with supporting elements arranged between them. A stressing spindle is arranged within the structural element parallel to the outer structural shells and coinciding with the intended main direction of loading of the structural element. The spindle bears axially spaced threaded sleeves which are fastened in non-rotating manner in the structural element and have flange-like transverse supports which are operatively connected at their free edges with said outer structural shells.

49 Claims, 3 Drawing Figures

Figure 1:
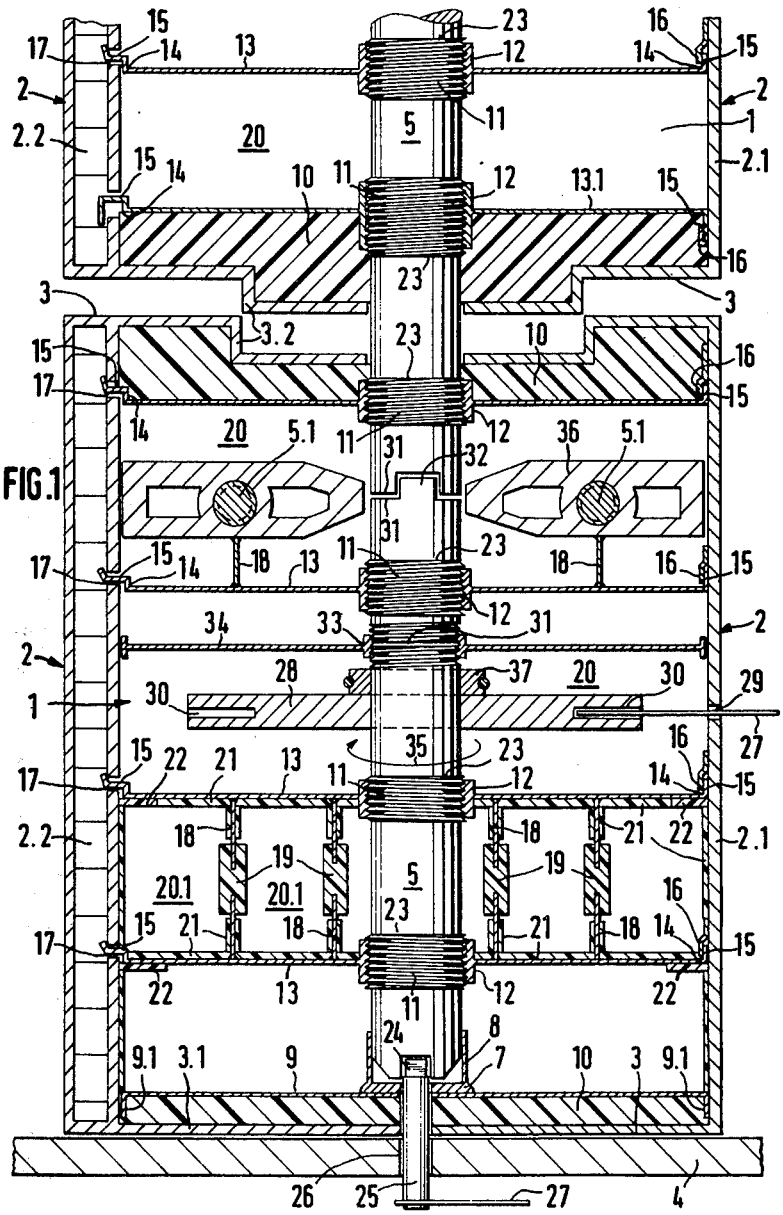

PRESTRESSED HOLLOW CHAMBER COMPOSITE STRUCTURAL ELEMENT CAPABLE OF SUPPORTING HEAVY LOADS

BACKGROUND OF THE INVENTION

1. Field of the Invention

The present invention relates to a hollow-chamber composite structural element capable of supporting heavy loads, which is prestressed in the direction of its length and against the direction of the action of loading and consists of two outer structural shells connected along their edges so as to form a frame, with supporting elements arranged between said shells.

2. The Prior Art

A structural element of this type is described in the applicant's German Patent Application No. 1937086. The prestressing is effected there as the action of transverse pressure on the surface of the outer structural shells in the direction towards the inside of the hollow chamber, by means of transversely clamped anchoring screws so that corrugated sheets arranged within the structural element parallel to the structural shells are stretched and press inwards against the frame-shaped edge connection.

SUMMARY OF THE INVENTION

The object of the present invention is to create prestressed hollow-chamber composite structural elements which are capable of supporting high loads and have a more favorable distribution of the initial stress, but which are to consist of standard elements which can be produced simply, and thus at low cost, and assembled without difficulty at the place of installation; these composite structural elements should, at the same time, have good thermal and acoustic damping properties so that they can also be used as load-bearing elements for creating or subdividing utility rooms.

This object is achieved in accordance with the invention essentially such that at least one stressing spindle, which is supported against the structural element and rotatable about its axis, is arranged within the structural element parallel to the outer structural shells thereof and coinciding with the predetermined main direction of loading. The spindle carries axially spaced threaded sleeves which are fixedly fastened against rotation in the structural element and have flange-like transverse supports. The flange-like transverse supports are, in turn, operatively connected at their free edges with the outer structural shells, stressing the latter in tension in the direction parallel to the stressing spindle.

Axial displacement of the transverse supports caused by turning the stressing spindle in the composite structural element assembled from the individual parts causes the outer structural shells, while still in the unloaded condition of the structural element, to be stretched in the direction of their surface length. A plurality of transverse supports, spaced apart from each other on the stressing spindle, are at the same time provided for distributing the forces of attack for the said stretching. Since the subsequent loading action is directed opposite this initial stretch-stressing of the outer structural shells, a very substantial load-bearing capacity is assured for the structural element. This is particularly so because the solid or tubular stressing spindle, due to the transverse supports which act as lateral transverse support members, increases the resistance to inward buckling of the structural shells and therefore also of the composite structural element as a whole.

The connection of the transverse supports to the inside of the outer structural shells may advisedly be effected in such a manner that a form-locked functional connection is established, which prevents both the inward and the outward buckling of the building shells. It can be done, for instance, such that the free edges of the transverse supports which adjoin the inside of the structural shells are bent in the direction in which the tension is exerted and engaged behind corresponding angles which are fastened to the structural shell and are either formed integrally on the inner wall surface of the structural shells or subsequently fastened to them or, in the case of multi-shell structural shells, are formed by holes in the inner-most shell of the multi-layer structure. This form-locked connection of the free edges of the transverse supports to the outer structural shells thus, at the same time, results in a high load-bearing capacity, even in the event of asymmetric loading, which in itself is undesirable, such as forces acting for instance obliquely on the edges of the structural element.

For producing the initial stretch-stressing in the outer structural shells the transverse supports can be provided with bends at their free edges in the axial direction of the stressing spindle, half of which are directed in opposite directions, and with correspondingly arranged corresponding angles at the structural shells. It is structurally simpler and sufficient for many purposes, on the other hand, to support the stressing spindle at at least one end against the inside of an edge connection of the two outer structural shells by introducing the corresponding end of the stressing spindle, for instance, rotatably mounted, into a blind-hole sleeve with a pressure plate. The pressure plate comprises the edge connection and, therefore, the edge-side front of the structural element. For an easily produced but hermetically sealed connection of such a structural element to the surface of the corresponding support structure, for instance the concrete floor of a building shell or foundation, it may be advisable to make the edge connection of flexible material and to arrange a closure body between said edge connection, between the two outer structural shells and the pressure plate, for the supporting of the end of the stressing spindle. The closure body is preferably of at least slightly compressible material so that the resting pressure is transmitted from the end of the stressing spindle uniformly to the contact surface of the supporting structure, thereby developing a good seal.

In order to avoid, on the one hand, difficult designs for the considerably stressed transverse supports, but on the other hand to impart them with the necessary stability for transferring force from the stressing spindle to the outer structural shells, the transverse supports are advisedly provided with a stiffening profile member, for example, hollow-cylindrical pieces. The stiffening profiles which face each other can — in accordance with another feature of the invention — be connected with each other via elastic connecting profiles so that the hollow chambers defined by the outer building shells and two adjacent transverse supports are subdivided into individual chambers which are hermetically closed off from each other. In particular, it is advisable to provide such a stiffening-profile/connecting-profile/-chamber subdivision concentrically with the stressing spindle so that special measures with respect to the other hollow chambers are no longer required at the places of passage of the stressing spindle through the transverse supports.

The stressing spindle or spindles need by no means be vertical and the transverse supports accordingly need not be aligned parallel to the surface of the load-bearing structure; thus, on basis of the oblique stresses of the composite structural elements which are to be expected, the stressing spindles may be correspondingly inclined in order to counter in advance this expected direction of stressing by the prestressing of the outer structural shells. In the practical realization of the hollow-chamber composite structural elements of the invention, a plurality of stressing spindles is preferably arranged alongside of each other in a plane parallel to the outer structural shells in order to be able to exert a uniform strong tensile prestressing on the outer structural shells, even without excessively stable transverse supports which extend out to a far distance laterally, namely as a result of the support via a plurality of stressing spindles. This plurality of stressing spindles, arranged alongside of each other, also need not be aligned in parallel to each other; thus there are frequent cases of loading which act on a comparatively merely short length of the upper edge of a structural element but are to be transmitted via the width of the structural element in large area over the lower edge connection of the outer structural shells to the load-bearing structure. In this case it is advisable, for the tensile prestressing of the outer structural shells against the direction of the load distribution from the upper edge to the lower edge connection resting on the load-bearing structure, to arrange the stressing spindles at an angle to each other, in such a manner that they point to a specific limited region on the upper edge of the structural element, while the resting surface of their opposite ends is supported via a wide base which almost equals the width of the structural element.

In order to produce an approximately uniform initial stress with respect to any desired directions of stressing it is advisable to provide stressing spindles within the composite structural element which are aligned transversely to each other so that a two-dimensional tensile prestressing is obtained in the outer structural shells. Since the transversely, namely horizontally, aligned stressing spindles are without support while in still unstressed state, it is advisable to provide transverse-spindle supports which, referred to the first-mentioned stressing spindles, are guided radially by the latter such that they are, for instance, pushed in sleeve-manner over the vertical or substantially vertical stressing spindles. Since these transverse-spindle supports also extend up to the inner surface of the outer structural shells, they represent an additional internal support against the possible inward bending of the outer structural shells. The fixing in height of these transverse-spindle supports is advisedly effected by the adjacent transverse supports, which are axially fastened by their threads to the vertical stressing spindle, for instance by attachment to their stiffening profiles, which thereby serve also as spacers. Since the transverse-spindle supports are, in principle, axially displaceable (with respect to the substantially vertical stressing spindles), the stiffening profiles can be fastened rigidly not only to their transverse supports but also to these transverse-spindle supports. As a result of this arrangement, an inner supporting of the space between the two opposing outer structural shells is simultaneously obtained.

For reasons of manufacture, transportation, and mounting, particularly in the case of composite structural elements of substantial boundary lengths, it may be advisable not to develop the stressing spindles in a single piece but to divide them, in their pressure region, between adjacent transverse supports and assemble them so that they turn together, for instance by a splined or square-pin connection. For assembling the stressing spindles which are subdivided in longitudinal direction, an internally threaded connecting sleeve which is preferably supported radially against the inside of the structural shells can be used. The facing ends of the subdivided tensioning spindles are inserted therein initially merely temporarily, whereupon they are tightened by turning the tensioning spindles.

In accordance with another feature of the invention, the tensioning spindles do not have a continuous external thread but merely external-thread sections in the vicinity of the intended position of the transverse supports. When assurance is present that the threadless sections between every two adjacent external-thread sections of this type are at least of a length that corresponds to the height of the threaded sleeves of the transverse supports, then the individual external-thread sections can be provided with different thread pitches so that, with a uniform angle of rotation for the threaded spindles, different axial movements of the transverse supports, and thus different tensioning forces, are produced on the external structural shells.

In order to assure that, after the hollow- chamber composite structural element is mounted, at least the intended tensile stresses are exerted on the outer structural shells by the turning of the stressing spindles but impermissibly large tensile stresses are not produced by an erroneous excessive turning of the tensioning spindles, it is advisable in accordance with a further feature of the invention to distribute the individual externally threaded sections associated with the transverse supports on the tensioning spindles and in particular limit them axially; this is done such that the threaded sleeves of the transverse supports are turned out of said externally threaded sections by the turning of the threaded spindles and, in the position from which no further axial displacement of the transverse supports is any longer possible, exert optimum pre-stressing force on the associated region of the outer structural shells. This feature furthermore has the particular advantage that the arrangement of the threaded sleeves for the transverse supports upon the mounting of the composite structural element is not critical, since the tensioning spindles are simply turned until all threaded sleeves have moved out of their externally threaded sections; i.e. it cannot happen as a result of a mistakenly wrong initial position of a transverse support that a region of the outer structural shells is not stressed at all, or that it is overstressed.

By the stressing spindles which are guided transversely to each other in the transverse spindle supports, inserted in torsionally rigid manner, a very stiff, and accordingly highly loadable, grid-shaped supporting structure is created within the hollow-body composite structural element. Beyond this, however the solution in accordance with the invention, provides still further advantageous possibilities, especially in that these stressing spindles can be used simultaneously for the stressing against each other of hollow-chamber composite structural elements of the same manner of construction, which are set up independently of one another. For this purpose, it is contemplated in accordance with a further feature of the invention that at least one of such structural element stressing spindles, extending in the direction towards another similar composite structural element, will be arranged in front of the boundary thereof, extending at least on one side through the edge connection, at its end, into the adjacent structural element. The spindle will extend there at least into one pressure plate provided with a threaded sleeve and/or into the first adjacent transverse support of the adjacent structural element. By a suitable opposed inclination of the associated external-thread section, the adjacent composite structural element is then pulled-up simultaneously upon the turning of the structural spindle for the application of the prestressing tension on the outer structural shells; the adjacent structural element thus presses itself, for instance in the manner of a tongue-and-groove profiling, via its edge connection into the correspondingly developed edge of said first-mentioned structural element.

As a turning device which can be operated from outside the structural element, there can be provided a profile developed in one end of the tensioning spindle, perhaps a square socket into which an appropriate square stud with a lever is inserted through a slot in the pressure plate, the edge connection and the supporting construction; i.e. after installation and adjustment of the co-aligned composite structural elements above the supporting construction, the tensioning spindles are turned for the purpose of connecting the structural elements which are arranged one above the other under a simultaneous stressing of the outer structural shells from the space underneath through the supporting construction.

The turning device can also be arranged inside the structural element, preferably in the form of a wheel which is connected with the tensioning spindle and locked against rotation, the wheel having outwardly directed radial bores into which the turning lever for rotating the wheel, and with it the tensioning spindle, may be inserted through a small, horizontal slot in one of the outer structural shells.

The walls of the individual chambers of the hollow-chamber composite structural element are efficiently covered, according to the present invention, with acoustic insulating and/or ray-reflecting material and are preferably equipped with a steam-proof layer, so that by connection and pressing together of the individual construction elements of the composite structural element they are sealed in vapor-tight manner from each other; this gives the structural element according to the invention excellent sound- and heat-insulating attributes. Also to attain hermetic seals after axial displacement of the transverse support at the transition to the inner surface of the outer structure shells, flexible sealing lips are efficiently arranged against the adjoining structural shell on the free edges of the transverse supports.

It is especially efficient to provide hollow chambers on the inside of the structural elements which are divided from one another with flexible elastic dividing walls, according to a further development of the present invention. This is because, in addition to the heat insulating effect of the structural element, the acoustic insulating effects can thereby be influenced and improved. These elastic dividing walls extend, in individual chambers, parallel or essentially parallel to the longitudinal extent of the structural element in order to part the inner space of the structural element. The flexible attributes of these dividing walls result from the elasticity of the materials selected for use, and/or from the tensile stress on the braced structural element in such a way that especially disturbing frequency ranges are greatly deadened by a stressing of the structural element in the audible frequency range.

At least one stressing spindle is provided for applying tensile stress to stress the structural element. However, this spindle need not act on the outer structural shells directly over the transverse supports; the stressing spindle can also be used to stress a scissor-grid-lever which forces expansion of the outer structural shells either directly or over transverse supports. One advantage of this "scissor-stress" especially lies in the ability to vary the tensile stress above the height of a structural element by means of the scissor-grid geometry influence, without which complicated stressing spindles with different thread pitch over their length are needed for applying such different tensile stress.

Figure 2:
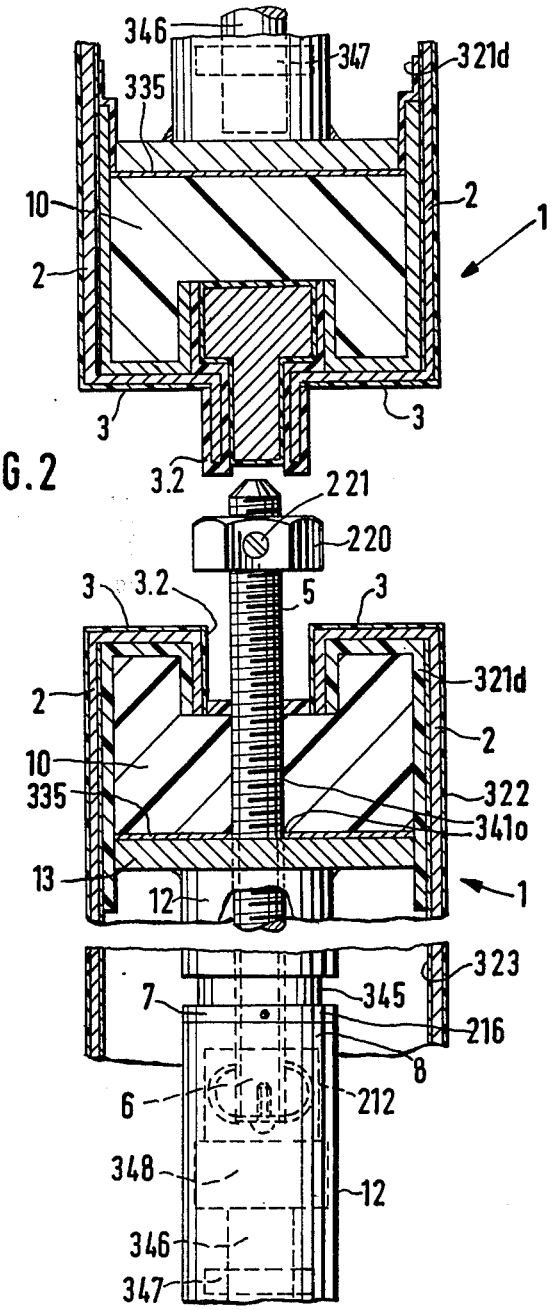
Figure 3:
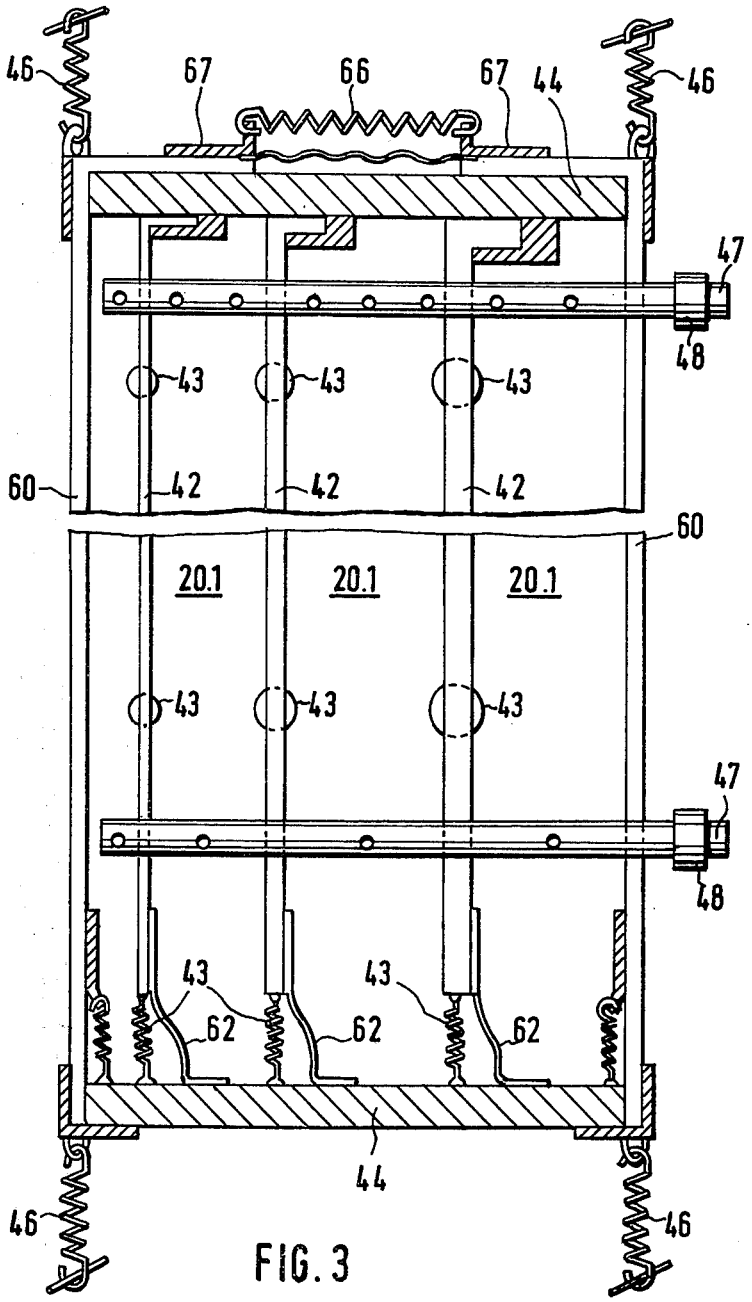

Further features and advantage of the high-load-bearing hollow-body composite structural element of the invention, which can be used preferably as a wall element but also for other structural purposes, will be noted from the dependent claims and from the following description of illustrative embodiments shown, simplified to their essentials, in the drawings. They show:

FIG. 1 a diagrammatic sketch for explaining the cooperation of the essential construction elements of the structural element;

FIG. 2 a modified example comparable to the diagrammatic illustration of FIG. 1; and FIG. 3 a diagrammatic drawing for explaining the selective sound-absorbing effect of reflective foils mounted adjacent one another, and tensioned, inside the individual chambers of the structural element.

Because of the high load carrying capacity of the structural elements in relation to their low weight, they can be used in different ways according to the present invention, such as for support elements in the construction of buildings, as walls or ceiling constructions for halls, tunnels, or the like, as well as for supporting compartment construction elements in the construction of automobiles or airplanes. Especially advantageous is the use of the structural element, designed according to the invention, as a wall element in buildings, because of its high thermo insulating attributes.

The examples shown in the diagrammatic drawings of the hollow body composite structural element 1, according to the invention, serve as wall elements. Each structural element 1 consists of two larger structural shells 2, the right one of which is shown as a simple plate 2.1 while the left one of which is shown as a multilayer honeycomb-shaped composite structural shell 2.2. The two outer structural shells 2 are connected with each other in frame-like manner along their edges 3, the lower edge of the lower structural element 1 being developed as a flat edge-connectiion 3.1, which rests flat on a load-bearing structure 4. The upper edge 3 of the lower structural element 1 and the opposite lower edge 3 of the upper structural element 1 which is arranged above and aligned with it, have an interacting tongue-and-groove profiling 3.2, by which a form-locked connection is obtained upon assembly of the structural element 1 along these opposing edges 3.

Within each structural element 1 there is arranged at least one stressing spindle 5, which is aligned parallel to the plane of the outer structural shells 2 and in the direction of the expected action of the load on the structural element 1. FIG. 1 therefore is an elevation transverse to the lengthwise direction of the outer structural shells 2 through the axis of the stressing spindle 5.

In order to simplify the drawing, the stressing spindle 5 has been shown of solid construction. In actual practice, a tubular hollow-center stressing spindle 5 is preferably employed in order to save material and weight.

For the diagrammatic showing of FIG. 1, it is contemplated that the lower end 6 of the stressing spindle 5, resting on a thrust-bearing 7, is supported and radially guided, free for rotation, in a blind-hold sleeve 8; the sleeve is closed by a pressure plate 9 which extends between the two outer structural shells 2. The pressure plate 9 can, when so positioned, act as the flat edge-connection between the boundary edges of the outer structural shells 2; however, it is advisedly a structural element independent thereof which presses, preferably via a closure body 10, against the flat edge-connection 3.1. The flat edge-connection 3.2 is preferably combined rigidly with the edges of the outer structural shells 2. If this flat edge-connection 3.1 is certain to be flexible, for example when developed in the form of a foil, it is then particularly advisable to make the closure body 10 of an elastic material which is compressible within certain limits. Thereby, to a certain extent, any irregularities in the surface of the load-bearing structure 4 are counteracted by intimate contact with the flat edge-connection 3.1, and therefore a tight connection of the lower boundary of the structural element 1 against the load-bearing structure 4 is obtained. Angle supports 24 make certain that the transition from the edge connection 3.1 to the structural shells 2 will not warp when forces act on the structural shells 2.

In the longitudinal direction of the stressing spindle 5 there are provided, on the outer surface thereof, external-thread sections 11 which engage the internal thread of threaded sleeves 12. Threaded sleeves 12 bear flange-like transverse supports 13 which extend up to the outer structural shells 2. Turning of the stressing spindle 5 around its longitudinal axis produces an axial displacement of these transverse supports 13. Due to a difference in the pitch of the individual outer-thread sections 11, the amount of the axial displacement of the transverse supports 13 can be made different for a given angle of rotation of the stressing spindle 5.

The purpose of such axial displacement of the transverse supports 13 is to exert a tensile stress on the outer structural shells 2 in the direction opposite the load which is to be expected. For this purpose, the free edges 14 of the transverse supports 13 are in form-locked engagement with the adjacent structural shells 2. For conversion of the axial displacement of the transverse supports 13 into tensile stress in the plane of the outer structural shells 2, the free edges 14 can have bends 15 which point in the direction of the axial displacement of the transverse supports 13 and engage corresponding angles 16 fastened to the inner surface of the outer structural shells 2. In this manner, both inward and outward buckling of the outer structural shells 2 is dependably prevented as a result of the support against the bend 15 of the transverse supports 13. When composite structural shells 2.2 are employed, bend 15 can be developed in step-shaped manner in order to engage with an opening 17 as well as to provide a rest against the inner surface of the composite structural shell 2.2. In order to enable use of lightweight transverse supports 13 while definitely avoiding warpage due to tensile or compressive stressing from the outer structural shells 2, stiffening profiles 18 are subsequently applied to or developed directly integral with the surfaces of the transverse support 13. These stiffening profiles are preferably developed as pipe lengths of round or polygonal cross section concentric to the stressing spindle. Stiffening profiles 18 of adjacent transverse supports 13 pointing towards each other can be connected together by elastic connecting profiles 19. Profiles 19 can be stressed in tension, whereby the space clamped-through by the tensioning spindle 5 is closed off hermetically from the hollow chamber 20 between the outer structural shells 2 and the transverse supports 13. A plurality of such combinations of stiffening profiles 18 and stiffening profiles 19 divide the hollow chamber 20 into individual chambers 20.1 which are hermetically closed from each other. This is particularly advantageous if the walls of these individual chambers 20.1 are covered with acoustic and/or thermal insulating materials 21, and preferably with a vapor-tight insulating layer as well, since in this way the insulating action of all elements made of such structural shells 2 can be considerably increased. For the same reason, flexible sealing lips 22, which preferably rest elastically against the adjoining inner surface of the structural shells 2, are provided on the free edges 14 of the transverse supports 13. These sealing lips assure that, even during and after axial displacement of the transverse supports 13, an airtight closure of at least the outermost individual chamber 20.1 is maintained.

In order to obtain, even independently of the turning motion of the stressing spindle 5, only a limited axial displacement of the transverse supports 13 and therefore to be sure of avoiding an impermissibly high tensile stressing of the outer structural shells 2 over the bends 15, each corresponding externally threaded section 11 on the stressing spindle 5 has an end 23 which is defined in the axial direction of the stressing spindle 5 with respect to the arrangement of the associated corresponding angle 16 or the associated opening 17. Regardless of the initial position of the transverse supports 13 after assembly of the individual parts of the structural element 1, and independently of rotation of the stressing spindle 5 which is effected, axial displacement with simultaneous introduction of force into the outer structural shells 2 thereby results for each transverse support 13 only until the threaded sleeve 12 thereof has been turned out of the end 23 of the associated threaded section 11; even upon further turning of the stressing spindle 5, no further axial displacement of the transverse supports 13 will take place, the transverse supports being axially supported in fixed position in front of the end 23 of the associated threaded section 11.

The turning of the stressing spindle 5 can be effected from its end 7, for example if the latter has a square embossing 24 into which a corresponding, for instance square, stud 25 can be introduced through a hole 26 in the support construction 4, edge connection 3.1, closure body 10, and pressure plate 9. On the other side of the supporting structure 4, a torque wrench 27 can be placed on the free end of the stud for turning. That is, the stressing spindle 5 is rotated from the adjacent space after the structural element 1 is mounted in place, and the hole 26 for the introduction of the turning stud 25 can thereupon be closed.

Another suitable possibility for turning the stressing spindle 5 after the mounting of the structural element 1 consists in mounting a wheel, fixed against rotation, on the stressing spindle 5 within a hollow chamber 20 of the structural element 1. A horizontal slot 29 in at least one of the outer structural shells 2 is associated with the wheel. Torque lever 27 can be introduced through slot 29 into one of the radially outwardly opening boreholes 30 arranged peripherally around wheel 28; by horizontal swinging of lever 27, wheel 28 and stressing spindle 5 can be turned. After this stressing has been effected, slot 29 can be covered by a closure cover.

In accordance with the preferred embodiment shown, the stressing spindle 5 does not extend as a single piece through the entire height of the structural element 1, but is divided axially in the region of pressure zones. The individual stressing spindle parts are connected at their facing ends 31, fixed against rotation with respect to each other. This non-turnable connection can, in the simplest case, be a square-pin connection 32. Greater stability is obtained by the use of an internally threaded connecting sleeve 33 which is fixed to the one individual stressing spindle 5 and is screwed into the adjacent individual spindle 5 at its end 31 during the turning of the stressing spindle 5, and thus during the application of the initial stress, when the thread pitch is suitably adapted. Further stability is obtained by the use of a flange-like support 34 on the connecting sleeve 33.

The stressing spindle 5 extends through the upper edge 3 (as shown in the illustrated embodiment) and thus through the tongue-and-groove profiling 3.2 into the inside of the further structural element 1 located above. Simultaneously with the application of the initial stress to the outer structural shells 2 caused by turning of the stressing spindle 5, the two structural elements 1 are pressed against each other upon the engagement of the tongue-and-groove profiling 3.2. For this purpose (at least), the threaded sleeve 12 of the lowermost transverse support 13 in the upper structural element, as well as the associated externally threaded section 11, is provided with oppositely directed pitch so that upon the direction of turning 35 indicated by the arrow, not only are the transverse supports 13 shifted axially upward but, at the same time, this first transverse support 13.1 of the adjacent structural element 1 is moved towards the lower structural element 1. By means of bends 15 developed in accordance with this direction of movement and corresponding angles 16 or openings 17, the opposing edges 3 of the structural elements 1 which are to be arranged one above the other and clamped to each other are pressed against each other upon the turning of the stressing spindle 5.

In order to be able to insert stressing spindles 5.1 also in the transverse direction of the structural element 1, and therefore parallel to the support structure 4 as seen in the drawing, transverse-spindle supports 36 are provided. These supports 36 are guided axially, without thread, by the stressing spindle 5 and preferably rest on stiffening profiles 18 of the adjacent transverse support 13. Transverse-spindle supports 36 are preferably displaceable axially — with respect to the vertically shown stressing spindle 5 — against the inside of the outer structural shells 2, so that a rigid connection is made possible between the transverse-spindle supports 36 and the corresponding adjacent transverse supports 13 via their stiffening profiles 18. In this manner a supporting element of high torsional resistance is obtained within the structural element 1. Square-pin connections 32 of divided stressing spindles 5 are advisedly placed in the plane of the transverse spindle holders 36, in order to obtain additional stability here by radial support. The arrangement of stressing spindles 5 and 5.1, extending transverse to each other and connected together via the transverse spindle holders 36, produces a supporting structure of high load-bearing capacity within the structural element 1. The structure also extends into adjacent structural elements 1 and thereby produces a truss-like supporting brace extending over a plurality of adjacent structural elements 1 for the simultaneous prestressing of the outer structural shells 2.

In order to additionally support certain regions of the outer structural shells 2 against the danger of possible outward or inward bulging, at least the outer individual chambers 20.1 can be further provided with pressure or vacuum depending on the prestressing or loading conditions. If central or inner individual chambers 20.1 extend over the entire height of the structural elements 1, it is particularly advisable to evacuate at least one such plane of individual chambers 20.1 or at least fill same with a dried gas below atmospheric pressure. This further increases the acoustic and heat insulating effect of such composite structural elements 1.

In order to make certain that, upon the clamping together of the outer structural shells 2, no undesired asymmetries occur in the distribution of stress over the outer surface of the structural shells 2 as a result of the turning of the stressing spindles 5 and 5.1, transmissions 37 can be provided between adjacent stressing spindles 5. For example, the transmissions can be in the form of V-belt wheels, one of which is affixed for rotation with wheel 28 for the attachment of the torque wrench 27. In this way assurance is had that all stressing spindles 5 arranged parallel or essentially parallel to each other can be turned by means of only a single tool, namely a single torque wrench 27, through the same angle of turn; with suitable dimensioning of the transmissions 37, the angles of turn may differ in defined manner from each other for the corresponding adjustment of the transverse supports 13.

The final position of the transverse supports 13 is dimensioned predominantly from the standpoint of stability and is advisedly also established with regard to the fact that due to the stressing of the outer structural shells 2 their natural frequency is known to be substantially affected. The natural frequency can accordingly also be adjusted as desired, namely for optimum acoustic insulating properties of the structural element 1. Due consideration must be given to the interactions between the natural frequency of the outer structural shells 2 and the dimensions and possibly linings of the hollow chambers 20. A precise adjustment of the resonance or sound-transmission behavior of the structural element 1 as a whole can therefore also be effected by a suitable turning of the stressing spindles 5.

If the outer structure shells 2 are metal plates which are not directly in metallically conductive connection with each other via their edges or via metallic structural elements arranged in-between, measures for the equalization of potential should be taken in known manner, for instance by short-circuit paths in the form of copper lines which are connected to the edges or the inner surfaces of the outer structural shells 2 and connect the latter electrically to each other. If the stressing spindle 5 consists of non-metallic material but metallic structural elements are arranged within the structural element 1, it is advisable to arrange on or in the cylindrical surface of the stressing spindle 5 an electrical conductor which extends over the entire height of the structural element 1 and, by electrical contacting, produces a potential connection also to adjacent structural elements 1; all metallic structural parts within a structural element are then connected to this common potential bar via collector rings or preferably via flexible connecting lines which coil up upon the turning of the stressing spindle.

In FIG. 2 are shown modifications of the details from the diagrammatic illustration of FIG. 1. Here too, the tensioning spindle 5 serves to perpendicularly stress structural elements 1 against an anticipated loading direction. The lower front-end 6 of tensioning spindle 5 is, in this example, broadened by fastening thereto a lock ring 212. A thrust bearing 7 serves again to assure that the tensioning spindle 5 can turn without changing its longitudinal position within structural element 1 (a so-called endless screw). On the thrust bearing is provided a plate 216 which is arranged rotatably on the blind-end-bore casing 8. A screw 216*a* is arranged in plate 216. This screw extends perpendicularly to the longitudinal direction of the tensioning spindle 5 into a ring-groove, without interrupting its rotation. The tensioning spindle 5 further extends through a thread casing 12. By rotating tensioning spindle 5, thread casing 12 moves upwardly or downwardly according to the direction of rotation, in order to shift in the appropriate direction a transverse support 13 connected therewith. Transverse support 13 works together with the outer structural shells 2. The thread casing 12 can, however, be arranged such that it presses directly against the upper end 3 of the structural element 1.

For the operation of the tensioning spindle 5, a head-nut 220 can be mounted; head-nut 220 is shown above the structural element 1 for technical illustration purposes. For turning of the tensioning spindle 5, the head-nut is rigidly fixed on the tensioning spindle by means of a fastening screw 221. After tensioning, fastening screw 221 can be loosened to allow the head-nut 220 to be drawn tight for fixing the position of the tensioning spindle 5 against an edge 3 of the structural element 1. Tubes can be fastened to run at right angles to the lengthwise axis of the tensioning spindle 5, by means of which the structural element becomes a part of a composite frame arrangement between adjacently positioned structural elements. In cases in which it does not seem essential to let the tensioning spindle 5 stand out above the edge 3 of a structural element 1, the tensioning spindle can end within the structural element 1; in this circumstance, an appropriate axial length of the thread casing 12 assures that the pressure will be applied to edge 3 of the structural element 1 by reason of turning the tensioning spindle 5.

In FIG. 2, outside protection covers 322 and inside reflecting foils 323 are provided on the outer structural shells 2, to improve the heat insulating attributes of these structural elements. The tongue-and-groove profiling 3.2 of the edges 3 of two neighboring structural element 1 facing each other make possible a releasable or perminent (e.g. welded), air- and steam-tight connection of the structural elements 1 with one another. At the same time, this L-shaped profile lends the connection a higher mechanical solidity. For further increasing the solidity, a profiled sealing body 10 is also provided in the front-edge area of the outer structural shells 2, having a U-formed cross-section and being fixed to bridge the transverse distance between the outer structural shells 2. At the same time, sealing-body 10 secures an air- and steam-tight closing of at least this edge area of structural element 1, for which purpose additional sealing material 321*d* can be arranged on the inside of the outer structural shells 2. The tensioning spindle 5 sticks through a cylindrical opening 341*o* in the middle area of the sealing body 10, if the spindle should stick out of the edge 3 of the structural element.

In the explanation according to FIG. 2, each edge 3 of the structural element 1 has an associated thread casing 12 for transmission of the tension. The stronger the pressure from tensioning spindle 5 which presses the thread casings 12 over the plane-shaped transverse supports 13 against sealing body 10, the better the sealing of edges 3 of structural element 1. Because of this, an intermediate plate 335 is provided in front of each sealing body 10.

The tensioning spindle 5 can also be constructed in multiple parts so that after bracing of the structural element 1, the parts of the tensioning spindle 5 which reach out from the edge 3 of each structural element 1, including the head-nut 220 which may be provided are removed to make possible a conclusive joining with a neighboring structural element 1; if not for this purpose, for desirably joining a tensioning spindle 5 which passes through the adjoining structural element 1.

It may essential to provide the blind-end-bore casing 8 with a residual stress. For that purpose, an inner tube 346 with support rings 347 which fit tightly against the inner wall of the blind-end-bore casing 8 is provided in FIG. 2. A cylindrical contact pressure screw 348, contacting and inner thread in the blind-end-bore 8, is screwed with tension against the inner tube 346. The blind-end-bore casing 8 is thereby tensioned in the longitudinal direction. Contact pressure screw 348 is preferably arranged such that the lower end 6 of the tensioning spindle 5 is mounted on the contact pressure screw 348 without being hindered in its rotation.

To increase the heat-insulating effect, it is essential to cover the intermediate plate 335 and all other structural elements arranged in the hollow space of the structural element 1 with highly reflecting material, such as aluminum foil, which also promotes a steam-tight seal of the inner structural element 1.

By appropriate selection of material for the sealing body 10, its central, cylindrical opening 341*o* can be equipped with an inner thread; in this case the use of a separate upper thread casing with transverse supports 13 is superfluous, provided enough pressure can be put on the edges 3 for tensioning the outer structural shells 2 of the structural element 1. The lower thread casing 12 which operates as a tensioning tube can then reach up almost under the profile body 10. In addition to a two-piece arrangement of thread casing 12, a highly elastic sealing layer 345*c* can be provided around the open area of the tensioning spindle between the moving thread casing 12 or the profile body 10 and the stationary thread casing 12, which serves as a tensioning tube.

An encircling tube frame can be arranged between the U-shanks of the sealing body 10, which gives the structural element 1 additional load-bearing strength and bending resistance. Such a tube frame can be affixed to the structural element 1 by means of the head-nut 220 if no joining or tongue-and-groove connection of a neighboring structural element is provided.

All hollow spaces in the structural element 1 are preferably sealed air-tight, for building up either partial vacuum or gauge pressure. Additional stability due to increased buckling strength can be especially won by partitioning the hollow spaces in individual chambers 20.1 of the structural element 1.

FIG. 3 refers to the aforementioned preferable partitioning into individual chambers 20.1 of the hollow spaces within the structural element 1 by use of elastic connection profiles 19 or other flexible, elastic dividing walls. Such dividing walls selectively deaden frequencies within the range of audibility which influence the structural element.

In FIG. 3, such dividing walls are provided in different thicknesses to cause a varying natural resonance of the individual dividing walls 42, which demarc the individual chamber 20.1, having the same tensile stress (symbolized for clarity by springs 46). These flexible dividing walls 42 can consist of, for example, plastic, metal or a combination of elastic materials which are braced in the direction of their plane surface. Such dividing walls can be assembled and disassembled easily and can also be stored in a space-saving manner. An increase of the acoustic-insulating effect results from tuning to predetermined frequencies, when the individual dividing walls are arranged above the elastic tensioning elements 43 in a rigid frame 44, the internal frequencies of the tensioning elements 43 being tuned with the respective internal frequencies of the attached dividing walls 42. With a multiple membrane arrangement of this kind, the sound spectrum of interest can be covered continuously. Because such a structure does not produce a sharp resonance curve, however, it is sufficient to provide natural frequencies at relatively great distances from one another in dimensioning the dividing walls 42, because the areas in between are sufficiently covered by the broad resonance curve.

In this way, a broad sound spectrum which affects frame 44 and side casings 60 with sound transmitted through the structure and through the air is attenuated by being changed into heat caused by the vibration of dividing walls and their tensioning elements 43. Dividing walls 42 can be tuned to a predetermined middle-frequency of the sound spectrum in a simple manner by varying the length or width expansion of the dividing wall 42 within the dimension of frame 44 by appropriately selecting the length of the tensioning elements 43. A relatively broad frequency range can be covered if the tensioning elements 43 are not connected to the membrane shaped dividing walls 42 with rigid edge strips or the like, but instead only at points; this is because they result in dissipation of the vibrations at the edge area of the dividing walls, resulting in a broadened resonance curve. Of especially practical importance is the connection of the dividing walls 42 to the frame 44 over elastic tensioning elements; such elements largely prevent interference points on the edges of the membrane-shaped dividing walls 42. Vibration dissipation may be further influenced by combining tensioning elements 43 having different vibration characteristics. Thus, springs as well as weights can be provided as tensioning elements 43. It is especially effective to use elastic rubber construction components of a material with high damping coefficient as tensioning elements 43. These tensioning elements 43 are then efficiently adjusted mutually in their vibration dissipation so that the components of the vibration energy which are not changed into heat by the damping are largely neutralized within the frame 44 due to interference. To increase damping effects, appropriate clamping materials can be placed on the dividing walls 42 and/or on the tensioning elements 43, similar to the dampers which are clamped on the strings of stringed musical instruments.

It may further be useful to divide at least one part of the flexible elastic membrane-shaped dividing walls 42 geometrically within construction frame 44, such as with interposed or mechanically rigid dividing ledges, which are arranged to influence the vibration dissipation. When these dividing ledges are supported against the frame 44, it is possible to admit dividing walls 42 which are geometrically attached to each other with different braces for different resonance behavior. A further increase in the sound absorbing attributes of such a structure is attained if the membranes are perforated with predetermined geometry in order to forward those acoustic components which are received only weakly or not at all by a membrane, because of its resonance behaviour, to those dividing walls 42 which are adjusted to those frequencies. At the same time, the sound-damping effects through the individual chambers 20.1 result from appropriate dimensioning thereof, as in hollow-space resonators. Thus, the smaller spacings between neighboring dividing walls 42 are efficiently oriented toward the source of acoustic vibration.

As already mentioned, the described structure having individual chambers 20.1 divided from one another results in improved thermal insulating effects. These can be increased through use of highly reflecting covers, like aluminum, on the dividing walls 42 and the inner surfaces of the side casings 60. The thermal insulating attributes can be further increased when, as shown symbolically in FIG. 3, perforated tube sections 47 with valves 48 extend into the individual chambers 20.1 at least partially for evacuating those chambers when needed, and/or to fill them with dry gas for additional thermal insulation and/or as fire protection. If a partial vacuum should be provided in individual chambers 20.1 between the dividing walls 42 and the side casing 60, support having small bearing surfaces can be provided so that the side casings 60 in connection with the frame 44 need not be highly pressure-proofed. Such supports are in essence mutually axially displaced so that a sound bridge running directly therethrough is not built, and so that the appropriate areas of the dividing walls 42 can be utilized as damping elements. Axial sub-divisions with intermediate layers of elastic material to suppress the appearance of sound-bridges can also be provided. A further decrease of sound-bridges results when the dividing walls 42 and/or the side casings 60 are built up with multiple layers so that mechanical damping ensues by elongation stresses caused by contact surface friction.

The tensioning elements 43 shown in front elevation in FIG. 3 serve to brace the dividing walls 42 transverse to the drawing plane. In place of the symbolically shown discrete tensioning elements 43, and edge formation of the dividing walls can also be provided such that elastic zone exists which serve to flexibly fasten the dividing walls immediately on the frame 44. The dividing walls 42 can be fastened rigidly on the frame 44 at one edge for simplifying the mechanical construction, as shown diagrammatically in FIG. 3. When fastening the tensioning element 43 at points to the frame 44 for defining the individual chambers 20.1, as shown in FIG. 3, an elastic sealing tape 62 is provided, which may be glued to the appropriate edge of each dividing wall 42. The thickness of dividing walls 42 for attaining different natural resonances is drawn in an exaggerated form in the drawings for clarity. In practice, tuning of the natural resonances can be also attained with the uniform material thickness by means of the tensioning or appropriate selection of the material for the dividing walls 42, especially so if the walls are constructed of multi-layered smooth materials.

If the side casings 60, which consist of especially hard-wearing and high-loading material, are laid around the edges of the frame 44, it is effective for stressing the side casings 60 to provide isolated tensioning springs 66 which connect over tensioning ledges 67 on the facing edges of side casings 60.

If it is possible to replace the tensioning elements 43 with weights in the particular construction, and this substitution is made, then the sealing tape 62 serves also to determine the appropriate edges of dividing walls 42 opposite frame 44.

I claim:

1. A hollow-chamber composite structural element capable of carrying high load and being prestressed in the direction of its length and against the direction of loading, comprising two outer structural shells connected with each other in frame-like manner along their edges and having supporting elements arranged between them; at least one stressing spindle which is turnable around its axis arranged within and supported against the structural element parallel to said outer structural shells and coinciding with the intended main direction of loading of the structural element, said spindle bearing axially spaced threaded sleeves which are fastened in non-rotating manner in the structural element and have flange-like transverse supports, said transverse supports in turn being operatively connected at their free edges with said outer structural shells, stressing said shells in tension in direction parallel to said stressing spindle.

2. A structural element according to claim 1, wherein said free edges of said transverse supports are connected in form-locked manner with the outer structural shells to support said structural shells against lateral inward or outward bulging.

3. A structural element according to claim 1, wherein said stressing spindle is provided, at least at one end, with a resting surface against the inside of the edge connection of said structural shells.

4. A structural element according to claim 3, wherein said resting surface comprises a blind-hole sleeve having a pressure plate which presses against a compressible closure body within the edge connection.

5. A structural element according to claim 1, wherein said transverse supports have stiffening profiles.

6. A structural element according to claim 5, wherein said stiffening profiles comprise hollow cylinder lengths which are arranged concentrically to the spindle axis.

7. A structural element according to claim 5 wherein said stiffening profiles of adjacent transverse supports are connected with each other via an elastic connecting profile for defining individual chambers.

8. A structural element according to claim 1, wherein transverse-spindle supports are provided.

9. A structural element according to claim 8, wherein said transverse-spindle supports are fixed radially against said stressing spindle and against the structural shells, as well as axially against said stiffening profile of an axially adjacent transverse support.

10. A structural element according to claim 1, wherein said stressing spindle is divided in its pressure regions between adjacent transverse supports and assembled in rotation-locked manner.

11. A structural element according to claim 1, wherein said stressing spindle is provided with external-thread sections only in the region of said transverse supports.

12. A structural element according to claim 11, said external-thread sections have a different pitch depending on the desired distribution of tensile stress in said outer structural shells.

13. A structural element according to claim 11, wherein said external-thread sections have, in axial direction, an end in accordance with the desired distribution of tensile stress in said structural shells.

14. A structural element according to claim 1, wherein said stressing spindle extends, at least on one side, through the edge of one said structural element into a similarly constructed adjacent structural element, and extends there at least into one pressure plate provided with a threaded sleeve and into the first adjacent transverse support thereof, the associated external-thread section having a thread pitch opposite that of the other external-thread sections.

15. A structural element according to claim 1, wherein a turning device which can be actuated from outside the structural element is provided.

16. A structural element according to claim 15, wherein said turning device comprises a profile developed at one end of said stressing spindle.

17. A structural element according to claim 15, wherein said turning device is a lever which can be actuated through a slot in one of said structural shells, with which lever there is associated within the structural element a wheel which is connected, locked in rotation, to the stressing spindle.

18. A structural element according to claim 7, wherein the walls of the individual chambers are covered on the inside with acoustic-insulating and ray-reflecting damping material and are preferably sealed in vapor-tight manner from each other.

19. A structural element according to claim 1, wherein flexible sealing lips resting against the adjoining structural shell are arranged on the free edge of said transverse supports.

20. A structural element according to claim 1, wherein a sealing-body is provided as a front-end facing last transverse support.

21. A structural element according to claim 1, wherein said tensioning spindle is supported at one end against a flat edge connection above an axial thrust bearing.

22. A structural element according to claim 21 wherein said supported spindle end is led into a blind-end bore casing.

23. A structural element according to claim 22 wherein said axial thrust bearing is provided as a rotatable plate on the opening of said blind-end bore casing, and said blind-end bore casing is formed as a tube-piece which has inside a concentrically arranged stabilizing tube working together under the load from said tensioning spindle.

24. A structural element according to claim 1 wherein a scissor-grid arrangement is provided for the transmission of the tensile stress to the outer structural shells.

25. A structural element according to claim 24 wherein said scissor-grid arrangement is equipped, in proportion to the tensile stress dissemination over the outer structural shells, with scissor links of different scissor-lever length.

26. A structural element according to claim 7 wherein said connecting profiles are formed, for the mutual demarcation of individual chambers, as elastic, flexible dividing walls which are braced in the direction of their plane.

27. A structural element according to claim 26 wherein each dividing wall is stressed separately over tensioning elements and is tuned to a specific natural resonance.

28. A structural element according to claim 26 wherein dividing walls are provided under one another of different structure and different thickness.

29. A structural element according to claim 26 wherein the distances between the dividing walls are not the same among one another.

30. A structural element according to claim 29 wherein the distances between the dividing walls of one of the totality of the individual chambers increases from one outer side casing to the facing outer side casing.

31. A structural element according to claim 26 wherein in a dividing wall plane, dividing walls of different natural resonance are arranged next to one another.

32. A structural element according to claim 26 wherein on the dividing walls, and especially along their edge zones and assembly points, suitable reinforcements are provided for influencing the resonance behavior.

33. A structural element according to claim 26, wherein the edge zones of the dividing walls, compared to the other zones thereof, are respectively formed elastically and serve as the tensioning elements.

34. A structural element according to claims 26, wherein along the edge zones of the dividing walls, different tensioning conditions are caused by connection of the tensioning elements at points.

35. A structural element according to claim 26 wherein said tensioning elements are attached to said dividing walls in displaced directions.

36. A structural element according to claim 26 wherein the free ends of the tensioning elements are fastened on a rigid frame by interposed flexible hanging fastening elements.

37. A structural element according to claim 36 wherein said fastening elements and the dividing walls, consist of vibration-damping material.

38. A structural element according to claim 26 wherein vibration dampers are provided in connection with flexible fastenings of said dividing walls.

39. A structural element according to claim 26 wherein weights are provided as tensioning elements.

40. A structural element according to claim 34 wherein along the edges of the dividing walls which are not fastened to run through a frame, sealing tapes are arranged, which expand elastically to the neighboring parts of the frame.

41. A structural element according to claim 40 wherein said frame is braced elastically.

42. A structural element according to claim 26 wherein at least some of said dividing walls are provided with perforations having geometry tuned to the natural resonance of the neighboring dividing walls parallel thereto arranged.

43. A structural element according to claim 42 wherein at least some of the individual chambers are tuned as hollow-space resonators on frequencies which lie between the resonant frequencies of the two neighboring dividing walls.

44. A structural element according to claim 30, wherein said facing side casings are pulled around said frame and are braced elastically with one another on the facing front endges.

45. A structural element according to claims 26 wherein said individual chambers are closed air-tight and steam-tight and have a partial vacuum.

46. A structural element according to claim 26 wherein said dividing walls are covered with a highly reflecting material.

47. A structural element according to claim 45 wherein said individual chambers are filled with an inerted gas, like dried air, below the outside pressure.

48. A structural element according to claim 45, wherein transverse supports are arranged, displaced axially from one another, between said dividing walls, to influence the vibration geometry thereof.

49. A structural element according to claim 48 wherein vibration absorbing materials are arranged in series with said transverse supports.

* * * * *